US010480524B2

(12) United States Patent
Rhyner et al.

(10) Patent No.: US 10,480,524 B2
(45) Date of Patent: Nov. 19, 2019

(54) EDDY PUMP IMPELLER

(71) Applicant: EDDY Pump Corporation, El Cajon, CA (US)

(72) Inventors: Phillip Cyrus Rhyner, San Diego, CA (US); Dan Wahlgren, El Cajon, CA (US); Mugdha Shrikant Dokhale, San Diego, CA (US)

(73) Assignee: EDDY PUMP CORPORATION, El Cajon, CA (US)

( * ) Notice: Subject to any disclaimer, the term of this patent is extended or adjusted under 35 U.S.C. 154(b) by 226 days.

(21) Appl. No.: 15/360,713

(22) Filed: Nov. 23, 2016

(65) Prior Publication Data

US 2018/0142691 A1 May 24, 2018

(51) Int. Cl.

| | |
|---|---|
| ***F04D 7/02*** | (2006.01) |
| ***F04D 29/20*** | (2006.01) |
| ***F04D 29/02*** | (2006.01) |
| ***F04D 29/42*** | (2006.01) |
| ***F04D 29/22*** | (2006.01) |
| ***F04D 7/04*** | (2006.01) |

(52) U.S. Cl.
CPC ..... *F04D 29/2244* (2013.01); *F04D 7/04* (2013.01)

(58) Field of Classification Search
CPC .... F04D 29/2244; F04D 7/04; F04D 29/2238; F04D 29/24; F04D 29/242; F04D 29/245; F04D 29/2211; F04D 29/2216
USPC ..... 416/188, 180, 223 R, 234, 237, 223 B
See application file for complete search history.

(56) References Cited

U.S. PATENT DOCUMENTS

| | | | | |
|---|---|---|---|---|
| 2,247,813 | A * | 7/1941 | Huitson | F04D 29/284 29/889.4 |
| 2,710,580 | A | 6/1955 | Holzwarth | |
| 3,065,954 | A * | 11/1962 | Whitaker | F01D 5/045 415/218.1 |
| 3,644,056 | A * | 2/1972 | Wiselius | F04D 29/2277 415/143 |
| 4,594,052 | A | 6/1986 | Niskanen | |
| 4,596,511 | A | 6/1986 | Weinrib | |
| 4,776,753 | A * | 10/1988 | Weinrib | F04D 7/04 415/120 |
| 4,792,275 | A | 10/1988 | Weinrib | |
| 4,815,929 | A | 3/1989 | Weinrib | |
| 4,904,159 | A | 2/1990 | Wickoren | |
| 4,914,841 | A | 4/1990 | Weinrib | |
| 5,242,268 | A | 9/1993 | Fukazawa et al. | |
| 5,586,863 | A * | 12/1996 | Gilbert | F04D 7/065 415/200 |
| 6,139,274 | A | 10/2000 | Heer | |
| 6,158,959 | A | 12/2000 | Arbeus | |

(Continued)

*Primary Examiner* — Richard A Edgar
*Assistant Examiner* — Brian O Peters
(74) *Attorney, Agent, or Firm* — Global IP Counselors, LLP

(57) ABSTRACT

An eddy pump impeller includes a hub having a planar rear surface, the hub tapering from the planar rear surface to a conical front end, and a plurality of blades extending from the hub. Each of the plurality of blades has an outer surface essentially parallel to a rotational axis of the hub, inversely tapers from the hub, and has a front surface tapering in height from the front conical end, such that the plurality of blades is configured to cause an eddy current and cause a fluid stream to be forced to the outside of the impeller.

38 Claims, 4 Drawing Sheets

(56) References Cited

U.S. PATENT DOCUMENTS

| | | | | |
|---|---|---|---|---|
| 6,290,467 | B1 * | 9/2001 | Dewhirst | F01D 5/025 416/244 R |
| 6,398,498 | B1 | 6/2002 | Boyesen | |
| 7,318,703 | B2 * | 1/2008 | Schober | F04D 29/2222 415/206 |
| 2009/0169374 | A1 * | 7/2009 | Ilves | F04D 29/2288 415/206 |
| 2012/0121421 | A1 * | 5/2012 | Wait | F04D 29/2277 416/185 |
| 2015/0030457 | A1 * | 1/2015 | Yamamoto | F04D 29/023 416/234 |
| 2017/0102005 | A1 * | 4/2017 | Schuldt | F02B 33/40 |

* cited by examiner

EDDY PUMP IMPELLER

BACKGROUND

Field of Invention

This invention relates to improvements in an impeller for pumping fluid. More particularly, the present Eddy pump impeller provides optimal pump efficiency to pump immiscible fluids and solids.

Background Information

There are a variety of different pumps for pumping a variety of liquids, materials and comingled liquid and solids. The shape of the impeller and the number of blades effects the efficiency of the overall system. The volume of each blade also changes the efficiency of the system and the volume of material that is pumped. The profile of the impeller as the fluid flows both into the impeller and out of the impeller further can change the efficiency of the system. Different types of pumps require different types of impeller size and shape. When pumping comingled fluids and solids, it is important to minimize direct contact of solid material to the impeller.

Different types of impellers have been patented to pump liquids and or comingled liquids and solids. A number of patents and or publications have been made to address these issues. Exemplary examples of patents and or publications that try to address this/these problem(s) are identified and discussed below.

U.S. Pat. No. 2,710,580 issued on Jun. 14, 1995 for H. T. Holzwarth, discloses a Vaned Rotor. This vaned rotor draws fluid into the center of the rotor and uses six curved vanes to push fluid out the sides of the rotor. While this vaned rotor can pump fluids, any debris in the fluid can jamb between the rotor blades and the housing. Any solids must first be pulverized prior to entering the pump.

U.S. Pat. No. 4,594,052 issued on Jun. 10, 1986 to Toivo Niskanen discloses a Centrifugal Pump for Liquid Containing Solid Material. The configuration of this pump utilizes three curved blades that also draw fluid into the center of the impeller and then fling to the exhaust port of the pump. The curved nature of the blades can break small fibers or sticks that enter the curved blades. While this centrifugal pump can pump liquids containing solids, if the solids contain metals, the tight dimensions of the impeller to the pump housing can cause damage to the impeller and the housing.

U.S. Pat. No. 7,318,703 issued on Jan. 15, 2008 for Martin Schober et al., discloses an Impeller for a Pump. This impeller is used for a pump, particularly for a cooling water pump of an internal combustion engine where the input fluid being pumped does not contain any solid material. This impeller further is constructed with six curved blades. That will be damaged from pumping hard solids.

What is needed is an Eddy pump impeller that has a tapered central cone with an optimized number of blades that improves the efficiency of the pump. The impeller presented in this document provides the solution with an impeller that is optimized for use in an Eddy pump.

SUMMARY

It is an object of the Eddy pump impeller to have a plurality of blades (e.g., five blades). Five blades are preferable since they provide clearance for material and liquid to enter between the blades and provide optimal pumping. With four blades there are less blades to provide pumping action and with six blades the blades occupy too much area and prevent sufficient material from entering into the impeller. The five blade design provides the best balance of pumping volume and clearance for movement of material.

It is an object of the Eddy pump impeller to have a tapered central hub. The tapered central hub provides a smooth transition for the material and fluid being pumped to enter into the blades of the impeller. Material and liquids that enter into the central area of the impeller are typically moving more slowly, a conical central hub divides the inflow to the impeller blades. Materials that enter at the outer sides of the impeller blades will join the movement of the fluid stream and will be pumped out.

It is an object of the Eddy pump impeller to have a flattened end plate. The flattened end or back plate reduces fluids and material from entering behind the impeller. The back plate tapers from the front tapered central hub to provide increased impeller blade surface area to smooth the transition from the leading to the trailing end of the impeller blade.

It is another object of the Eddy pump impeller to operate in an Eddy pump. The use of this impeller on an Eddy pump is an ideal combination where the Eddy pump lifts fluid and debris into the impeller and the impeller can then fling fluid and debris out of the pump where it can be separated. Even ridged material, rocks and metal can be pumped because these materials are moved through the fluid stream and make minimal or no contact to the impeller.

It is still another object of the Eddy pump impeller to have improved efficiency. The improved efficiency reduces the electrical costs to operate a pump. Even a small change of efficiency can have a significant change for electricity use when multiplied over hours, days, weeks, months and a year. As an example a 1% improvement of efficiency will save almost four day of electricity use in a year.

Various objects, features, aspects, and advantages of the present invention will become more apparent from the following detailed description of preferred embodiments of the invention, along with the accompanying drawings in which like numerals represent like components.

DESCRIPTION OF THE DRAWINGS

The invention will be explained in more detail hereinafter with reference to the drawings.

DETAILED DESCRIPTION OF THE INVENTION

Figure 1:
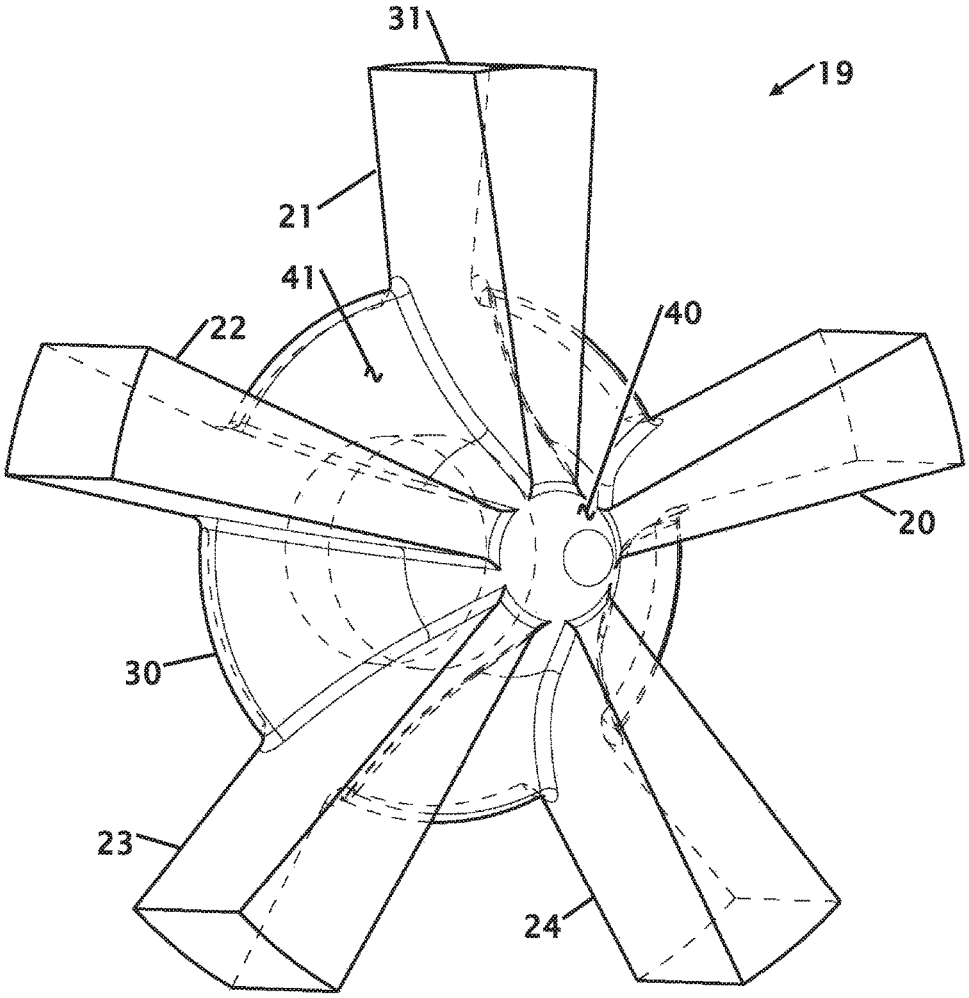
FIG. 1 shows an Eddy pump impeller.

FIG. 1 shows an Eddy pump impeller 19. This isometric view shows the impeller with five blades or vanes 20, 21, 22, 23 and 24. Each of the five blades 20-24 provide pumping force and the area between each of the five blades 20-24 provides clearance for material and liquid to enter between the blades 20-24 to provide optimal pumping. With four blades there are less blades to provide pumping action and with six blades the blades occupy too much area and prevent sufficient material from entering into the impeller. The five blade design provides the best balance of pumping volume and clearance for movement of material.

The outer diameter enables the outer surface 31 of the rotor 19 to have clearance within the pump housing the further provide induced movement of fluid within the pump. The back surface 30 of the rotor 19. Minimal flow exists behind the back surface 30 of the rotor 19. Fluids and solid material being pumped is drawn towards the central front cone 40 of the rotor 19. The flow then follows the tapered contour 41 of the rotor. The tapered central hub provides a smooth transition for the material and fluid being pumped to enter into the blades 20-24 of the impeller 19. Material and liquids that enter into the central area of the impeller are typically moving more slowly, a conical central hub divides the inflow to the impeller blades.

In the preferred embodiment the impeller 19 is fabricated from metal as either a cast, molded, forged or a machined impeller 19. While the preferred embodiment is alloyed metal, steel, stainless steel, aluminum, zinc, bronze, or metal, other material of plastics, rubbers, or hybrid materials are contemplated that could have equivalent, similar or superior properties. The preferred embodiment is also a material that will not rust or corrode in water, salt water or corrosive fluid environment. The impeller essentially operates by inertial rotation of fluids or material that is "caught" in the Eddy current of the rotating impeller where the centripetal rotating force of the fluid stream is forced to the outside of the impeller 19.

Figure 3:
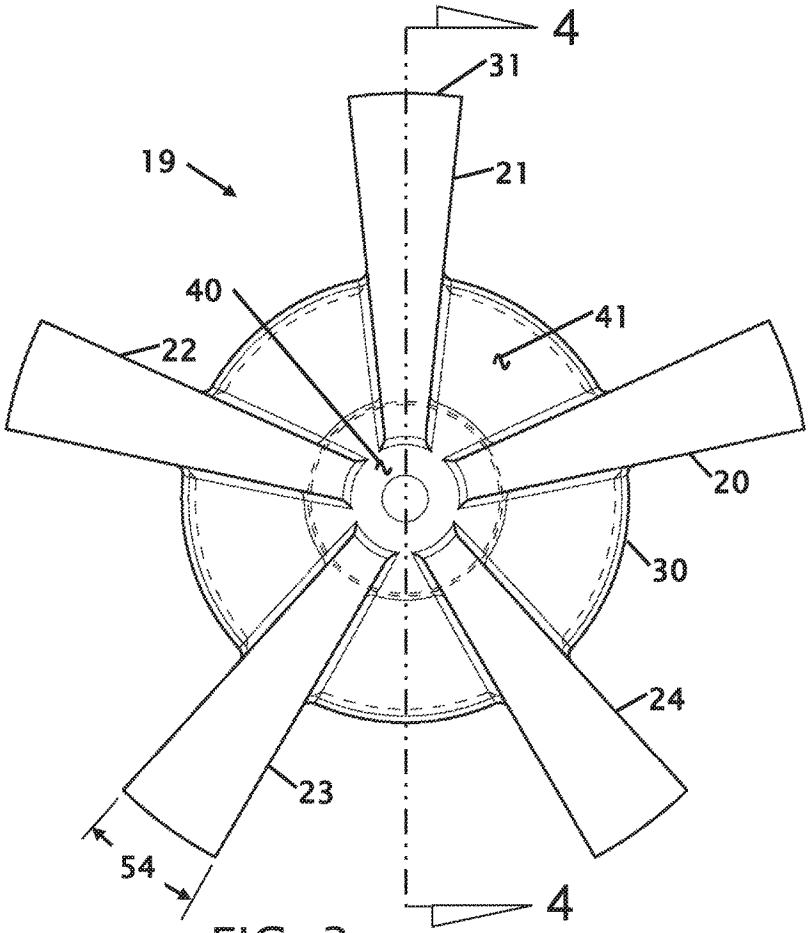
FIG. 3 shows a top plan view of the Eddy pump impeller.
Figure 2:
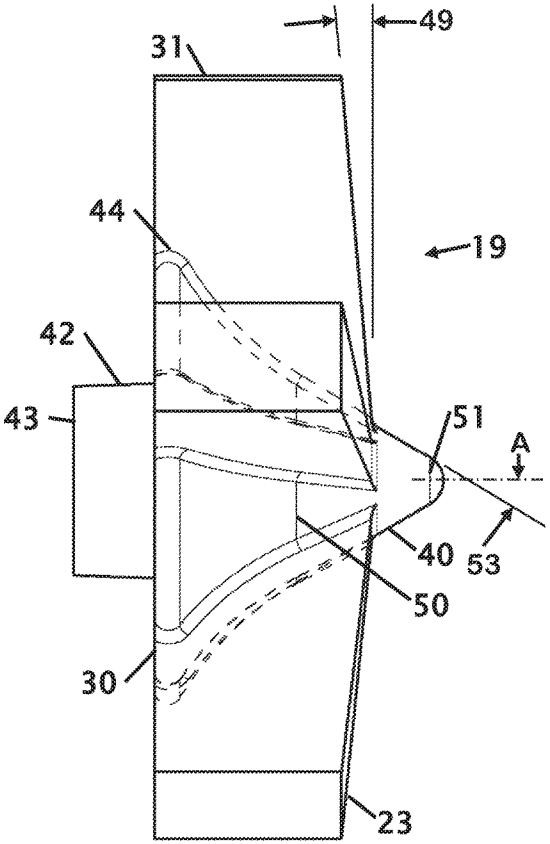
FIG. 2 shows a side view of the Eddy pump impeller.

FIG. 2 shows a side view of the Eddy pump impeller 19 and FIG. 3 shows a top plan view of the Eddy pump impeller 19. These views show the geometric features of the impeller 19 and the five blades 20-24. The outer surface 31 of the blades or vanes 20-24 show that the impeller 19 is round in configuration with a flat back surface 30 having an extended hub 42 that extends from the back surface 30 a raised land 43.

In the side view of FIG. 2 the central front cone 40 extends from the blades 20-24 at an angle 53 of between 20 degrees and 40 degrees from the central axis (rotational axis A) with a preferred angle of about 30 degrees. From the side profile of FIG. 2 the rotor angle 49 tapers in height between 2 and 10 degrees. In the preferred embodiment, the taper is about 5 degrees. The transitions from the blades 20-24 to the tapered contour 41 have fillets 44 to smooth the transition between the two surfaces.

From FIG. 3 the five impeller blades 20-24 are shown with an inverse tapering at an angle 54 of between 5 and 20 degrees. In the preferred embodiment the taper angle 54 is about 10 degrees. These figures show contemplated splits or breaks 50 and 51 in the conical section and or blades of the impeller 19. It is contemplated that these breaks can be separations, seam lines or different parts of the assembled impeller 19. These different sections allow for assembled, joined or connected elements of the impeller 19 for fabrication or installation onto a shaft of a motor for the pump. While specific angles and or angle ranges are given in this document, other dimensions and ranges are contemplated. The geometry may also be altered based upon the motor rating, pump geometry and material that is being pumped.

Figure 4:
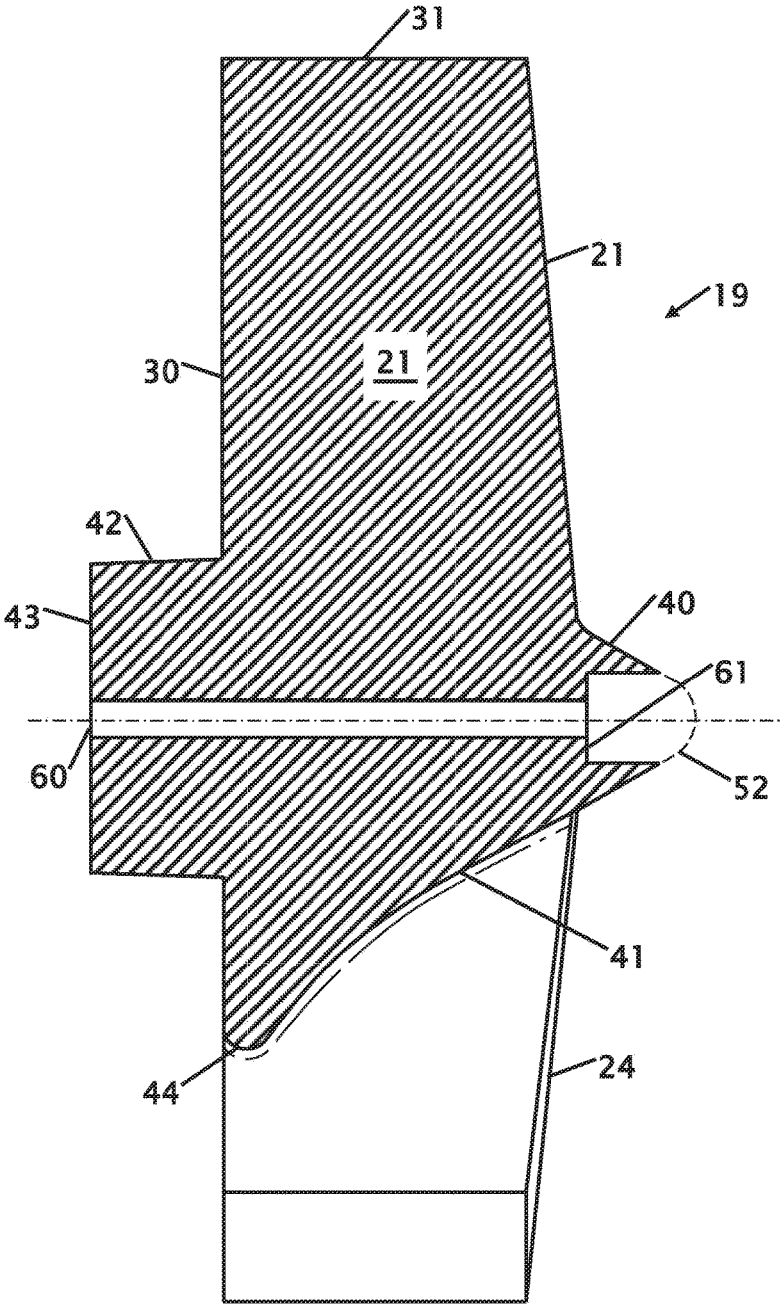
FIG. 4 shows a cross-sectional view of the Eddy pump impeller cut through section line 4-4 from FIG. 3.

FIG. 4 shows a cross-sectional view of the Eddy pump impeller 19 cut through section line 4-4 from FIG. 3. The solid blade surface 21 is the upper blade in this figure. While this figure shows the blade body as a solid member, it is contemplated that the blade can be hollow or opened at the rear of the blade to reduce weight without compromising pumping efficiency.

The Eddy pump impeller 19 has a central shaft or an opening for a central shaft 60 for mounting the impeller onto a motor. An extended hub 42 and a raised land 43 extend from the central shaft or the opening 60 for a central shaft of a motor. The hub 42 has a planar rear surface 30 that tapers to a front end of the central front cone 40. The outer surface 31 of the five blades (21 and 24 shown in this view) is essentially parallel to the central shaft or the opening for a central shaft 60.

The five blades extend from the mounting hub 42 from the planar rear surface 30. Each of said five blades inversely tapers from said central shaft or said opening for a central shaft. A front surface of the five blades is tapering in height from the front conical end 40. The fillet 44 is shown in this cross-section as the transition from the tapered contour 41 to the rear surface or back surface 30.

The cross-section shows an open nose area 52. Within this nose area 52, a nut or bolt can be seated on the land area 61. This will secure the impeller 19 onto the shaft of a motor that turns the impeller 19. It is further contemplated that the impeller can be held onto the motor of the pump on a keyed shaft that prevents the impeller 19 from spinning on the shaft, or the impeller can be held with a clutch that allows the impeller to rotate on the shaft if a torque is exceeded. This open area 52 is covered with a cap, the nut or other device that provides a smooth nose area for the flow of fluids.

Figure 5:
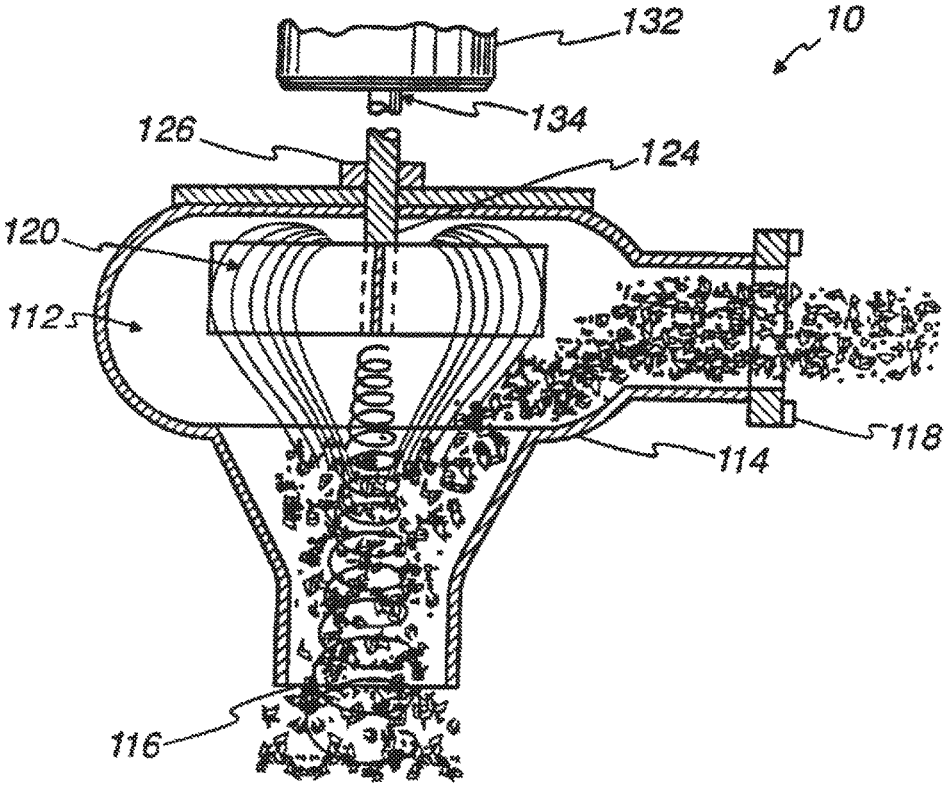
FIG. 5 is a diagrammatic view of a pump apparatus.

FIG. 5 is a diagrammatic view of a pump apparatus 10. The pump 112 comprises a pump housing or casing 114 having a pump inlet 116 and a pump outlet 118. Within the pump housing is a chamber 120 containing a rotating impeller or rotor. The rotor is affixed to a drive shaft 124 that extends through an opening 126 in the pump casing. The drive shaft is journaled for rotation within a bearing housing which is bolted to the pump casing at one end thereof. A drive means such as a motor 132 has a rotatable output shaft 134 coupled by a shaft coupling device to the drive shaft 124. Within the bearing housing are radial bearings and thrust bearings that locate and permit the drive shaft to rotate. It is desirable that liquid and foreign material, such as dirt or sand, be prevented from traveling along the shaft 134 from the pump casing opening 126 into the bearings to prevent contamination.

Thus, specific embodiments of an Eddy pump impeller have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An eddy pump impeller comprising: a hub having a planar rear surface, the hub tapering from the planar rear surface to a conical front end; and a plurality of blades extending from the hub; each of the plurality of blades having an outer surface essentially parallel to the rotational axis of the hub, inversely tapering from the hub, such that each of the plurality of blades has a width adjacent the hub that is less than a width adjacent the outer surface, and having a front surface tapering in height, such that the plurality of blades is configured to cause an eddy current and cause a fluid stream to be forced to an outside of the impeller wherein each of the plurality of blades inversely tapers at an angle of between 5 and 20 degrees.

2. The eddy pump impeller according to claim 1 wherein the front surface of each of the plurality of blades tapers in height between 2 and 10 degrees.

3. The eddy pump impeller according to claim 1 wherein the impeller is metal.

4. The eddy pump impeller according to claim 3 wherein the metal is selected from a group of metals consisting of alloyed metal, steel, stainless steel, aluminum, zinc, and bronze.

5. The eddy pump impeller according to claim 1 wherein the impeller is configured to be arranged in an eddy pump housing.

6. The eddy pump impeller according to claim 1 wherein the impeller is cast, molded, forged or machined.

7. The eddy pump impeller according to claim 1 is plastic or rubber.

8. The eddy pump impeller according to claim 1 wherein the conical front end extends beyond the front surface of each of the plurality of blades.

9. The eddy pump impeller according to claim 1 wherein a tip of the conical front end is rounded.

10. The eddy pump impeller according to claim 1 wherein the impeller has a hollow concentric cylindrical opening.

11. The eddy pump impeller according to claim 10, wherein the hollow concentric cylindrical opening is keyed.

12. The eddy pump impeller according to claim 1 wherein the plurality of blades are disposed such as to have equal angular spacing between each blade.

13. The eddy pump impeller according to claim 1 wherein a rear of each of the plurality of blades and or the hub is hollow.

14. A pump apparatus comprising: the eddy pump impeller according to claim 1; and a housing having an inlet and an outlet.

15. The pump apparatus according to claim 14 further including a motor connected to a central shaft.

16. The pump apparatus according to claim 14 wherein the inlet has an inlet conduit connected to the housing for receiving in the center thereof a rotational column of liquid.

17. The pump apparatus according to claim 16 wherein a rotational column discharges at an end of the outlet thereby inducing inward flow into the inlet conduit and in a direction opposite to the rotational column in the pump inlet.

18. The eddy pump impeller according to claim 1 wherein the impeller is configured to rotate fluid at a velocity in excess of 1800 r.p.m.

19. The eddy pump impeller according to claim 1 wherein the impeller is configured to pump material having a solids content of greater than 10% by weight of organic material therein.

20. An eddy pump impeller comprising: a hub having a planar rear surface, the hub tapering from the planar rear surface to a conical front end; and a plurality of blades extending from the hub; each of the plurality of blades having an outer surface essentially parallel to the rotational axis of the hub, inversely tapering from the hub, such that each of the plurality of blades has a width adjacent the hub that is less than a width adjacent the outer surface, and having a front surface tapering in height, such that the plurality of blades is configured to cause an eddy current and cause a fluid stream to be forced to an outside of the impeller wherein the front surface of each of the plurality of blades tapers in height between 2 and 10 degrees.

21. The eddy pump impeller according to claim 20 wherein each of the plurality of blades inversely tapers at an angle of between 5 and 20 degrees.

22. The eddy pump impeller according to claim 20 wherein the impeller is metal.

23. The eddy pump impeller according to claim 22 wherein the metal is selected from a group of metals consisting of alloyed metal, steel, stainless steel, aluminum, zinc, and bronze.

24. The eddy pump impeller according to claim 20 wherein the impeller is configured to be arranged in an eddy pump housing.

25. The eddy pump impeller according to claim 20 wherein the impeller is cast, molded, forged or machined.

26. The eddy pump impeller according to claim 20 is plastic or rubber.

27. The eddy pump impeller according to claim 20 wherein the conical front end extends beyond the front surface of each of the plurality of blades.

28. The eddy pump impeller according to claim 20 wherein a tip of the conical front end is rounded.

29. The eddy pump impeller according to claim 20 wherein the impeller has a hollow concentric cylindrical opening.

30. The eddy pump impeller according to claim 29, wherein the hollow concentric cylindrical opening is keyed.

31. The eddy pump impeller according to claim 20 wherein the plurality of blades are disposed such as to have equal angular spacing between each blade.

32. The eddy pump impeller according to claim 20 wherein a rear of each of the plurality of blades and or the hub is hollow.

33. A pump apparatus comprising: the eddy pump impeller according to claim 20; and a housing having an inlet and an outlet.

34. The pump apparatus according to claim 33 further including a motor connected to a central shaft.

35. The pump apparatus according to claim 33 wherein the inlet has an inlet conduit connected to the housing for receiving in the center thereof a rotational column of liquid.

36. The pump apparatus according to claim 35 wherein a rotational column discharges at an end of the outlet thereby inducing inward flow into the inlet conduit and in a direction opposite to the rotational column in the pump inlet.

37. The eddy pump impeller according to claim 20 wherein the impeller is configured to rotate fluid at a velocity in excess of 1800 r.p.m.

38. The eddy pump impeller according to claim 20 wherein the impeller is configured to pump material having a solids content of greater than 10% by weight of organic material therein.

* * * * *